US006338603B1

(12) United States Patent
Cerruti

(10) Patent No.: US 6,338,603 B1
(45) Date of Patent: Jan. 15, 2002

(54) PROCESS AND A MACHINE FOR THE MANUFACTURE OF COVERS FOR BOOKS AND THE LIKE, AND COVERS PRODUCED THEREBY

(75) Inventor: Francesco F. Cerruti, Turin (IT)

(73) Assignee: Finlega S.p.A., Turin (IT)

( * ) Notice: Subject to any disclaimer, the term of this patent is extended or adjusted under 35 U.S.C. 154(b) by 0 days.

(21) Appl. No.: 08/648,058

(22) PCT Filed: Nov. 22, 1993

(86) PCT No.: PCT/EP93/03260

§ 371 Date: Jul. 12, 1996

§ 102(e) Date: Jul. 12, 1996

(87) PCT Pub. No.: WO95/13925

PCT Pub. Date: May 26, 1995

(30) Foreign Application Priority Data

Nov. 18, 1993 (IT) ..... TO93A0866

(51) Int. Cl.[7] ..... B42B 1/00

(52) U.S. Cl. ..... 412/1; 270/52.08; 412/4; 412/8; 412/19

(58) Field of Search ..... 412/1, 3, 4, 8, 412/9, 16, 18, 19, 37; 270/58.07, 52.08

(56) References Cited

U.S. PATENT DOCUMENTS 5,127,786 A * 7/1992 Cross ..... 412/3
5,417,535 A * 5/1995 Andjelic et al. ..... 412/2
5,570,985 A * 11/1996 Latvakangas et al. ..... 412/4

FOREIGN PATENT DOCUMENTS

FR 2208343 6/1974

* cited by examiner

*Primary Examiner*—A. L. Wellington
*Assistant Examiner*—Monica Carter
(74) *Attorney, Agent, or Firm*—Sughrue Mion, PLLC

(57) ABSTRACT

A conveyer carries in series sheets of card or the like, having rectangular central apertures. When a layer of adhesive has been applied, a portion of flexible strip, which is wider than the central aperture, is applied to the central part of the lower face of each sheet. There is deposited on the lower face of this strip portion a layer of adhesive which is narrower than the central aperture, and a strip of card or the like is then applied to this layer. The inlet and outlet margins of each sheet are then sheared along parallel cutting lines which intersect the central aperture at right angles. When the corners have been trimmed, the margins of the sheets can then be turned over and stuck to the lower face.

15 Claims, 4 Drawing Sheets

3
3'
8
14
19'
33
36'
L1
L2
L3
L4

PROCESS AND A MACHINE FOR THE MANUFACTURE OF COVERS FOR BOOKS AND THE LIKE, AND COVERS PRODUCED THEREBY

BACKGROUND OF THE INVENTION

The present invention relates to a process for the manufacture of covers for books and the like.

BRIEF SUMMARY OF THE INVENTION.

The process according to the invention is characterized in that it comprises the operations of:

- arranging a plurality of sheets of card or the like, having overall dimensions which are greater than those of the covers to be produced and having a central aperture with a substantially elongate rectangular shape and dimensions which are greater than those of the spines of the covers to be produced;
- feeding these sheets in series to a conveyer which can entrain and guide this series of sheets in a direction parallel with the aperture, supporting these sheets such that a central portion of the lower face around this aperture is left free;
- applying a first layer of adhesive to a central strip of the lower face of each sheet about the central aperture;
- applying to this first layer of adhesive a portion of a flexible strip which is wider than the apertures in these sheets;
- applying a second layer of adhesive to a central strip of the lower face of the portion of the flexible strip applied to each sheet;
- applying to this strip of adhesive a strip of card or the like which is narrower than the apertures in the sheets;
- then shearing the ends of each sheet along lines which are parallel with one another and are perpendicular to and intersect the central aperture.

According to a further characteristic of the process, the flexible strip portions and the strips of card or the like are produced as a result of strips of flexible material and of card or the like, respectively, being cut transversely, the strips being wider than the length of the spine of the cover to be produced.

Advantageously, these flexible strip portions and strips of card or the like are applied to the sheets with a rotational movement in a plane which is substantially at right angles to that of the sheets, such that, at the moment when these strip portions or strips are applied, their speed is substantially equal to the advance speed of the sheets.

The invention also relates to an automatic machine for producing covers for books and the like.

A further subject of the invention is the covers for books and the like produced with the process or machine defined above.

Further characteristics and advantages of the invention will become clear from the following detailed description, given with reference to the appended drawings, provided purely by way of non-limiting example.

DETAILED DESCRIPTION OF THE DRAWINGS

Figure 1:
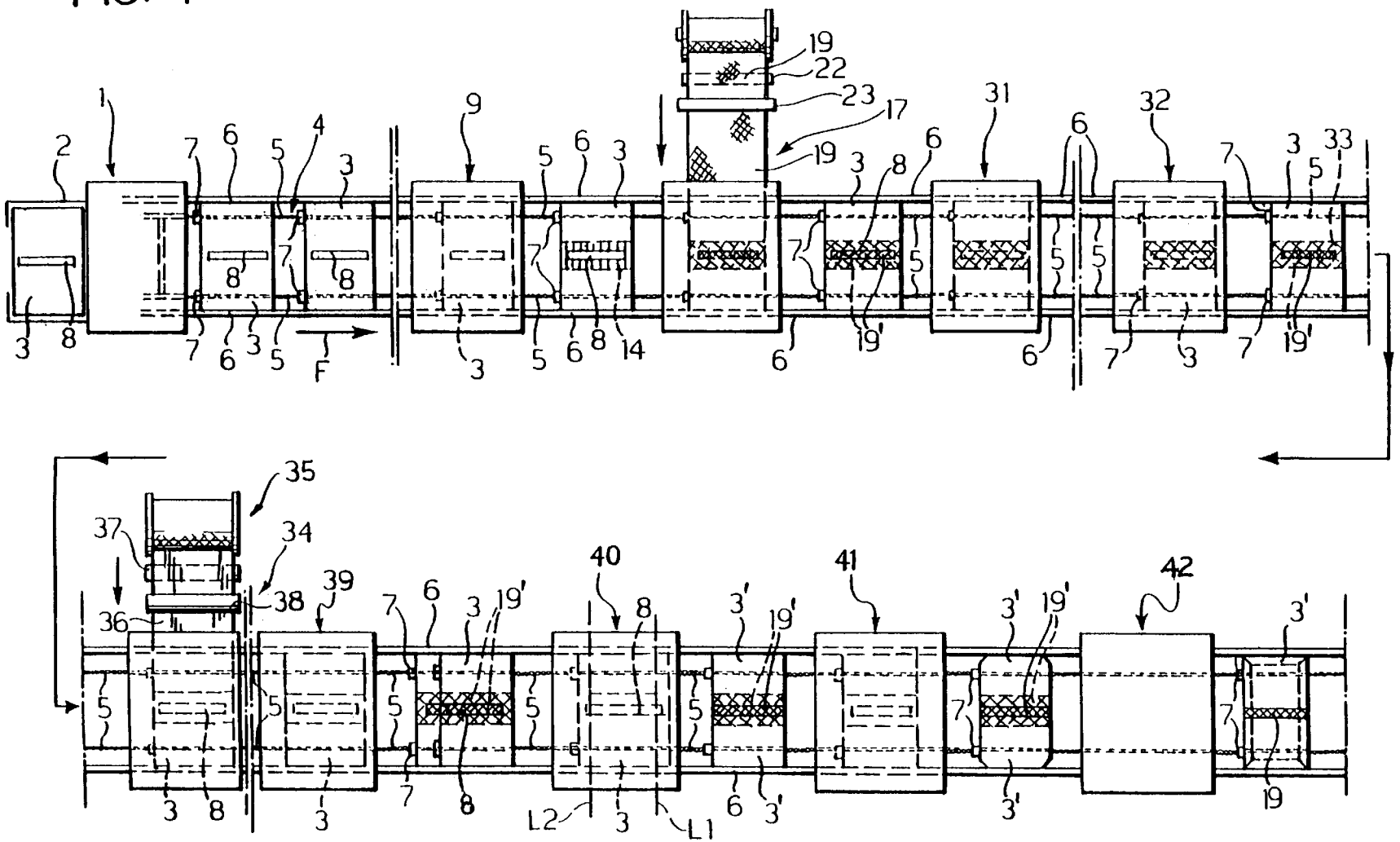
Figure 4:
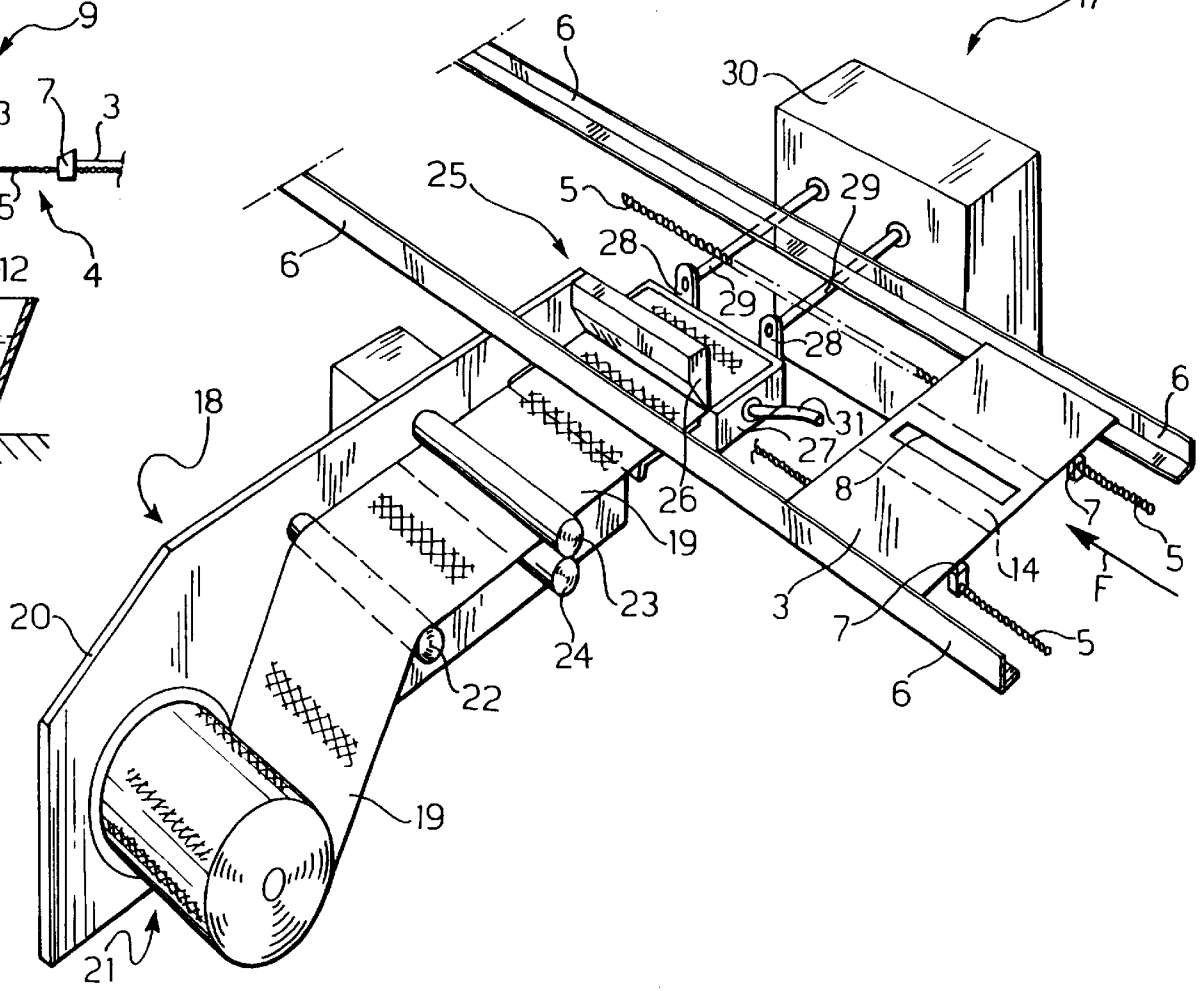
Figure 3:
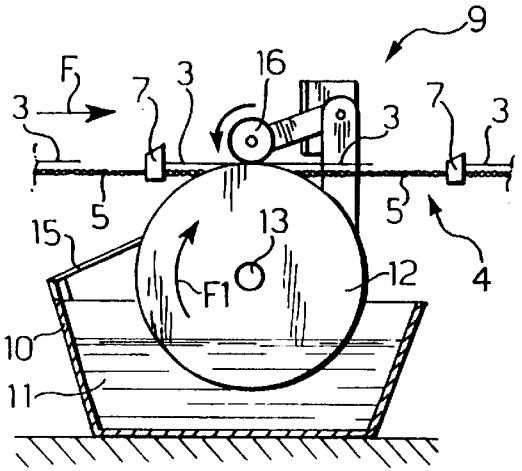
Figure 5:
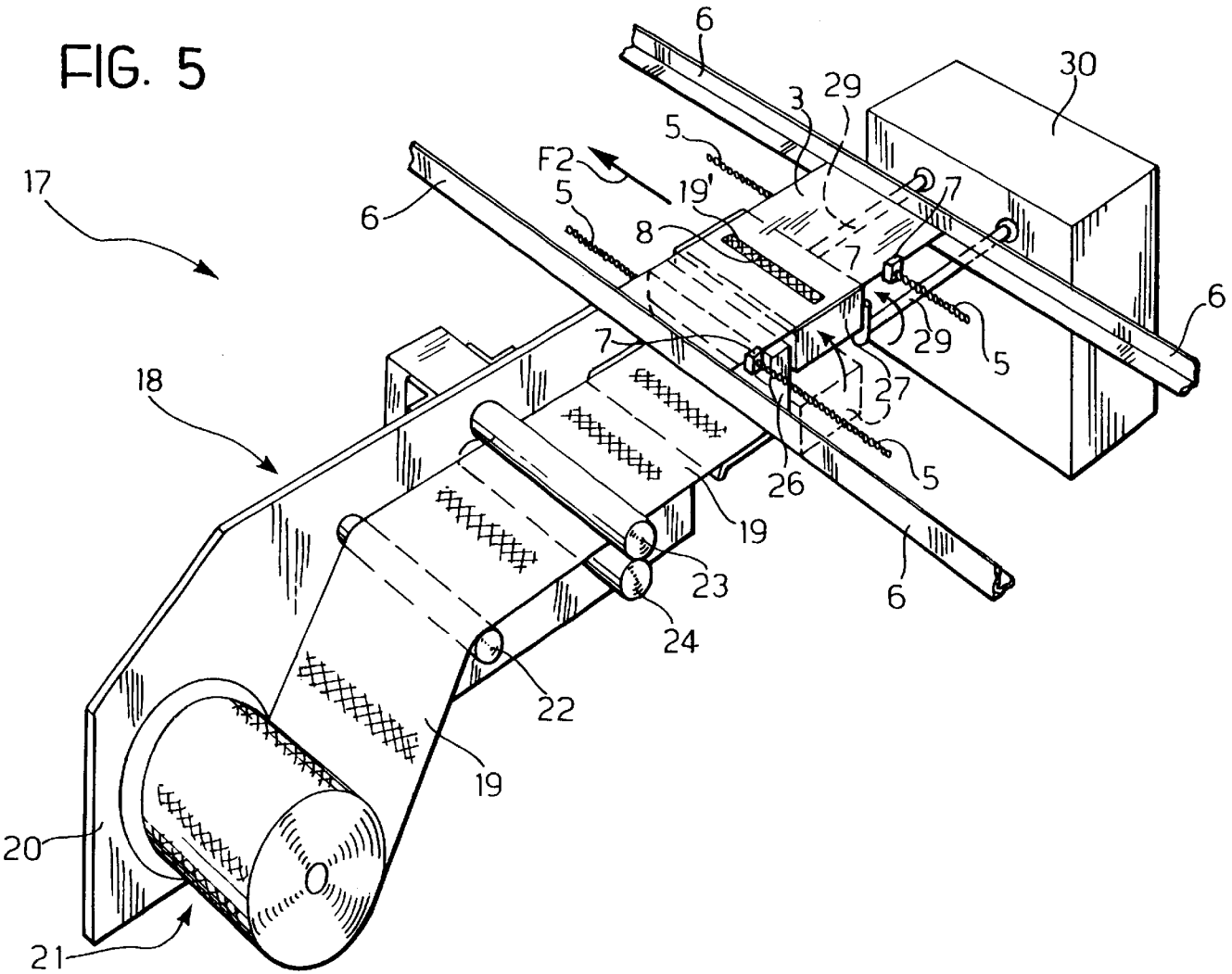

FIG. 1 is a diagrammatic illustration in plan view (viewed from above) of an automatic machine for producing covers for books in accordance with the invention;

FIGS. 2*a* to 2*h* are plan views of the lower or internal face of semifinished products obtained in the successive stations of the automatic machine of FIG. 1;

FIG. 3 is a side view, partially in section, of an adhesive applicator device comprised in the machine of FIG. 1; and FIGS. 4 and 5 are partial perspective views showing, in two different operating states, a station for the cutting and application of portions of a flexible strip to a sheet of card, comprised in the machine of FIG. 1.

DETAILED DESCRIPTION OF THE INVENTION

With reference to FIG. 1, an automatic machine for producing covers for books and the like according to the invention comprises a sheet feeding machine 1 of known type, such as, for example, a so-called feeder produced and marketed by the TEKGRAF company or by the MULLER MARTINI company. This machine comprises a loader 2 in which is disposed a stack of rectangular sheets 3 of card or the like. By means of devices with suction cups or the like, for example, the feeding machine 1, operating in known manner, takes the sheets from the loader 3 and deposits them in series on a conveyer 4. In the embodiment illustrated, the conveyer 4 comprises two chains 5 which run in the direction of the arrow F between two stationary side walls or guides 6. Connected to the chains 5 are entrainment members 7 which engage one side of a sheet 3 of card deposited on the chains of the machine 1.

The upwardly turned upper face of the sheets 3 of card or the like is the face corresponding, in the final cover, to the outer surface of the cover, or to the so-called first and fourth (faces) of the cover.

Figures 2A, 2B, 2C, 2D, 2E, 2F, 2G, 2H:
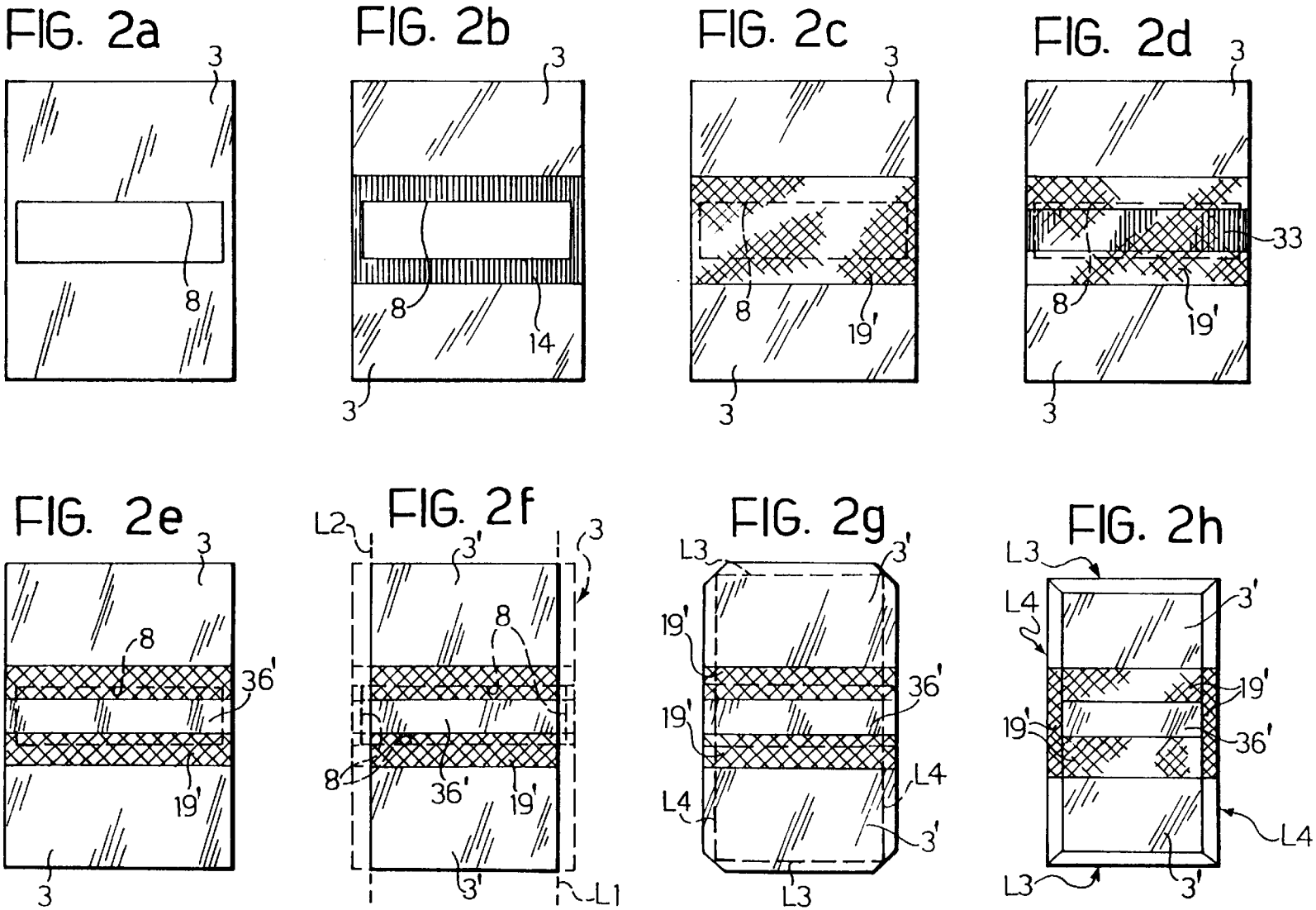

As shown in FIG. 1 and FIG. 2*a*, each sheet 3 of card deposited on the chains 5 has a central aperture 8 of a substantially elongate rectangular shape. The dimensions of this aperture are greater than those of the spine of the cover to be produced.

A first gluing station, generally indicated 9 in FIG. 1, is provided along the chain conveyer 4, downstream of the feeding machine 1.

In the embodiment illustrated in FIG. 3, the gluing station 9 comprises a container 10 in the form of a tank, disposed below the chain conveyer 4 and containing a liquid adhesive 11, for example a cold-type vinyl adhesive. The lower part of a wheel or roller 12 rotatably mounted on a shaft 13 is immersed in the adhesive 11, and its upper part extends between the chains 5 of the conveyer 4, adjacent the path of the sheets 3 of card or the like. As a result of the rotation (controlled by a motor which is not illustrated) according to the arrow F1 of FIG. 3, the lateral cylindrical surface of the wheel or roller 12 transfers a layer of adhesive and applies it to a central strip of the lower face of the sheets 3 transported by the chains 5, about the central aperture 8. In FIGS. 1 and 2*b*, the central strip of the lower face, provided with adhesive, of each sheet 3 is indicated 14. It can be seen that FIG. 2*b* shows the lower face of a sheet 3 leaving the gluing station 9, whilst, in FIG. 1, the sheet is viewed from above, and the strip of adhesive applied to this sheet is shown accordingly by hatched lines.

Advantageously, as shown in FIG. 3, the wheel or roller 2 is associated with a blade or scraper device 15 which reduces the thickness of the layer of adhesive 11 transferred by the periphery of this wheel or roller 12. In the embodiment illustrated, the blade or scraper device 15 is fixed to a side wall of the container 11 and its free end extends in the vicinity of the periphery of the wheel or roller 12.

Advantageously, the gluing station 9 further comprises a counter-roller 16 which idles about an axis parallel with that of the wheel or roller 12 and is disposed such that it presses each sheet 3 of card against this wheel or roller 12.

Downstream of the gluing station 9, along the conveyer 4, is provided a further station (generally indicated 17 in FIGS. 1, 4 and 5) in which, as will be described in further detail, a portion of a flexible strip, such as fabric or the like, is applied to the central strip, provided with adhesive, of each sheet 3.

As can be better seen, in FIGS. 4 and 5, the station 17 comprises an apparatus 18 which feeds the flexible strip 19 in a controlled manner in a direction substantially at right angles to the advance direction of the conveyer 4 comprising the chains 5. In the embodiment illustrated, this apparatus comprises a stationary support structure 20, at one end of which a coil 21 of strip is supported such that it can rotate about a horizontal axis. From this coil, the strip 19 passes over an idling transmission roller 22 with a horizontal axis, and then between a pair of opposite, horizontal rollers 23 and 24, of which at least one is motor-driven (preferably the lower roller 24). By means of these rollers, the strip 19 is advanced towards a cutting device, generally indicated 25, disposed below the path of the sheets 3 carried by the conveyer with chains 5.

The cutting device 25 comprises a fixed blade 26 directed transversely to the advance direction of the strip 19. This blade 26 is disposed slightly above the path of the strip 19.

A cutting and holding member 27, which is movable in a vertical plane and of which one edge is parallel with and adjacent the cutting edge of the blade 26, cooperates with the fixed blade 26. This movable cutting and holding member 27 can in particular be moved between a lowered position, shown in FIG. 4, in which its edge adjacent the blade 26 extends below the strip 19 to be cut, and a raised position, shown in FIG. 5, in which this edge extends above the cutting edge of this blade.

In the embodiment illustrated, the movable cutting and holding member 27 is parallelepipedal. In its lowered state (FIG. 4), the upper horizontal face of this member is disposed immediately below the end of the strip 19 to be cut.

The member 27 is articulated on the ends of two twin cranks 28 which are torsionally rigid with two parallel, horizontal shafts 29, of which at least one is rotatably driven by a drive assembly generally indicated 30. The cutting and holding member 27 can, therefore, be rotated and translated in a substantially vertical plane centred between the guides 6 and associated with the conveyer with chains 5.

In operation, the rollers 23 and 24 advance the end of the flexible strip 19 between the fixed blade 26 and the cutting and holding member 27 whilst the latter is in the lowered position. The drive assembly 30 then rotates the shafts 29 and imparts to the cutting and holding member 27 a rotary—translation movement such that this member, moving practically in contact with the blade 26 and with its edge turned towards the blade, cuts the end portion of the flexible strip 19 which thus rests on the upper face of this member. Advantageously, the member 27 comprises suction pipes which terminate in correspondence with apertures in its upper face. These pipes, connected to a vacuum pressure source (not illustrated) by means of a pipe indicated 31 in FIG. 4, allow the portion of the strip 19 which has been cut to be held steadily on this member, whilst this member continues its rotary—translation movement, in particular in the upward direction.

The operation of the feeding apparatus 18 and of the cutting device 25 is synchronized, by known means which are not illustrated, with the advance of the conveyer with chains 5 such that, when the cutting and holding member 27 reaches its highest position (FIG. 5), this member applies the cut strip portion 19' against the central strip, provided with adhesive, of the lower face of a sheet 3 carried by this conveyer. Subsequently, this sheet 3 continues to advance, as indicated by the arrow F2 of FIG. 5, whilst the cutting and holding member 17, continuing its movement, returns to its lower position, in order to cut a further portion of the flexible strip 19.

FIG. 2*c* shows the lower face of the sheet 3 of card or the like at the outlet of the station 17; as can be seen, the strip portion 19' applied thereto extends beyond the longer sides of the aperture 8.

On the other hand, the upper face of the sheet 3 at the outlet of the station 17 can be seen, on a smaller scale, in FIG. 1: the flexible strip portion 19' applied to its lower face can be seen through the central aperture 8.

Downstream of the station 17, the conveyer with chains 5 transfers the sheets 3 to a pressing station indicated 31 in FIG. 1. This station comprises pairs of counter-rotating pressing rollers or a pair of counter-rotating pressing strips which compress the flexible strip portion 19' firmly against the sheet of card or the like.

Downstream of the station 31 is provided a further station 32 for applying adhesive, similar to the station 9 described above. In this station, a wheel or roller which is immersed in the liquid adhesive present in a container applies a layer of this adhesive to a central strip of the lower face of the strip portion 19' applied to each sheet 3. The width of this strip or layer of adhesive is preferably equal to or greater than the width of the spines of the covers to be produced, and is indicated 33 in FIG. 2*d*. As these Figures show, the strip of adhesive 33 is preferably narrower than the central aperture 8 in the sheet.

The station 32 is followed by a station 34 (FIG. 1) structurally similar to the station 17 described above. In this station, there is applied to the central strip, provided with adhesive 33, of the lower face of the strip portion 19' applied to each sheet a strip or centre consisting of card or the like, which is narrower than the central aperture 8 in the sheet and substantially the same width as the desired width of the spine of the cover to be produced. To this end, the station 34 comprises a coil 35 from which unwinds a strip 36 of card or the like, which passes over a transmission roller 37 and then between two opposite rollers, of which only the upper one can be seen in FIG. 1, in which it is indicated 38. The strip 36 of card or the like has a transverse width which is at least equal to, but is preferably greater than, the length of the central aperture 8 in each sheet 3. The station 34 further comprises a cutting device similar to the one described above with reference to FIGS. 4 and 5, which cuts successive strips of this strip, of which each is applied to the strip of adhesive carried centrally by the strip portion 19' applied to each sheet.

At the outlet of the station 34, the lower face of the sheet is substantially as shown in FIG. 2*e*, in which the strip of card or the like applied centrally to the flexible strip portion 19' is indicated 36'.

Downstream of the station 34, the sheets are advanced to a further pressing station 39, similar to the station 32 described above.

The station 39 is followed by a shearing station 40. In this station, a shearing machine of known type, for example of the rotary type, shears the inlet and outlet ends of each sheet 3 perpendicular to the central aperture 8, along parallel cutting lines indicated L1 and L2 in FIGS. 1 and 2*f*. As can be seen better in FIG. 2*f*, the cutting lines L1 and L2 intersect the central aperture 8 in the vicinity of its ends.

Consequently, at the outlet of the station 40 (shown in FIG. 2*f*), the semifinished product is composed of two jackets or covers 3' connected by the flexible strip portion 19', to the centre of which a strip 36' of card or the like is applied.

This semifinished product can in principle already be used as a cover for books and the like. In this case, the faces of the jackets or covers 3' of FIG. 2*f* constitute the second and third (faces) of the cover, intended to be stuck to endpapers of a book block. In this case, the strip 36' of card or the like acts as the centre of the spine of the cover, whilst the parts 19' of fabric or the like between the longer sides of the strip 36' and the adjacent sides of the covers 3' act as hinges or joints which, in use, permit easy articulation of the cover for opening or closing.

In order to produce covers with margins which are more robust and better finished, the semifinished products leaving the shearing station 40 can be fed to a trimming station 41, of known type, in which the corners of these semifinished products are sheared obliquely, their lower faces then assuming the configuration illustrated in FIG. 2*g*.

The resultant semi-finished products are fed to a turning/gluing machine 42 (FIG. 1), of known type, which folds the margins of these semifinished products along the lines indicated L3 and L4 in FIG. 2*g* and, when adhesive has been applied, turns them onto the lower faces of these semifinished products which then assume the configuration illustrated in FIG. 2*h*. This Figure shows definitively the appearance of the interior of the finished cover which can thus be applied to a book block using the casing or stitching system.

The covers which can be produced by the process and machine according to the invention are simpler and more economical than the conventional covers bound in rigid paper boards, and the cover planes have articulation characteristics which are considerably better than the covers of the so-called "Dutch type".

Naturally, the principle of the invention remaining the same, the forms of embodiment and details can be varied widely with respect to what has been described and illustrated above purely by way of non-limiting example, without departing from the scope of the present invention.

What is claimed is:

1. A process for manufacturing covers for books and the like, characterized in that it comprises the operations of:

arranging a plurality of sheets (3) of card having overall dimensions which are greater than those of the covers to be produced and having a central aperture (8) with a substantially elongate rectangular shape and dimensions which are greater than those of the spines of the covers to be produced;

feeding these sheets (3) in series to a conveyer (4, 5) which can entrain and guide this series of sheets (3) in a direction parallel with the aperture (8), supporting these sheets such that a central portion of the lower face around this aperture (8) is left free;

applying a first layer (14) of adhesive to a central strip of the lower face of each sheet (3) about the central aperture (8);

applying to this first layer (14) of adhesive a portion of a flexible strip (19') which is wider than the apertures (8) in these sheets (3);

applying a second layer (33) of adhesive to a central strip of the lower face of the portion of the flexible strip (19') applied to each sheet (33);

applying to this strip (33) of adhesive a strip (36') of card or the like which is narrower than the apertures (8) in the sheets (3); and then shearing the ends of each sheet (3) along lines (L1, L2) which are parallel with one another and are perpendicular to and intersect the central aperture (8).

2. A process according to claim 1, characterized in that the flexible strip portions (19') and the strips (36') of card are produced as a result of a flexible material strip (19) and a strip (36) of card respectively, which is wider than the length of the back of the book to be produced being cut transversely.

3. A process according to claim 2, characterized in that the flexible strip portions (19') and the strips (36') of card are applied to the sheets (3) with a rotational movement in a plane at right angles to the plane of the sheets (3) such that, at the moment when the strip portions (19') or strips (36') are applied, their speed is substantially the same as the advance speed of the sheets (3).

4. A process according to claim 1, characterized in that the sheets (3, 3') of card are finally trimmed, and their margins are folded and stuck onto their lower faces.

5. A machine for manufacturing covers for books and the like, characterized in that it comprises in combination:

a sheet feeding machine (1) which can deposit in series onto a conveyer (4 to 7) sheets (3) of card having overall dimensions which are greater than those of the covers to be produced and having central apertures (8) of a substantially elongate rectangular shape and dimensions which are greater than those of the spines of the covers to be produced;

the conveyer (4 to 7) being produced such that it entrains and guides the series of sheets (3) in a direction parallel with the aperture (8), supporting these sheets (3) such that the central portion of the lower face about this aperture (8) is left free;

a first adhesive applicator device (9) which is interposed along the path of the conveyer (4 to 7) and can apply a layer of adhesive (14) to a central strip of the lower face of each sheet (3), about the central aperture (8);

a first feeding device (18) which can feed, in a controlled manner, a flexible material strip (19) which is wider than the length of the spine of the cover to be produced; this strip (19) being fed in a direction which is substantially at right angles to the advance direction of the conveyer (4 to 7);

a first cutting device (25) which is disposed downstream of the feeding machine (18) of the flexible strip (19) and below the path of the conveyer (4 to 7), and which can cut this strip (19) transversely, producing at each cut a strip portion (19') having a length which is less than or equal to the width of the central strip (14), provided with adhesive, of these sheets (3);

a first applicator device (27 to 30) which is associated with the first cutting device (25) and which can receive the flexible strip portion (19') each time it is cut, and which can bring this strip portion (19') into contact with the strip (14'), provided with adhesive, of the lower face of a sheet (3) transported by this conveyer (4 to 7);

a second adhesive applicator device (32) which can apply a second layer of adhesive (33) to a central strip of the lower face of the strip portion (19') applied to each sheet (3);

a second strip feeding machine (35) which can feed a strip (36) of card of which the width is greater than or equal to the length of the spine of the cover to be produced; this strip (36) being fed in a direction substantially at right angles to the advance direction of the conveyer (4 to 7);

a second cutting device (34), which is disposed downstream of the second strip feeding machine (35) and below the conveyer (4 to 7), and which can cut the strip (36) of card transversely, producing at each cut a strip (36') which is narrower than the width of the central aperture (B) of the sheets (3);

a second applicator device (34) which is associated with the second cutting device and which can receive the strip (36') of card each time it is cut, and can bring this strip (36') into contact with the strip of adhesive (33) applied to the central part of the lower face of the flexible strip portion (19') applied to each sheet (3);

a shearing station (40) disposed near the conveyer (4 to 7) downstream of the second cutting device (34) and disposed so as to shear the inlet and outlet ends of each sheet (3) perpendicular to the central aperture (8), along parallel cutting lines (L1, L2) intersecting the aperture (8); and control means which can coordinate and synchronize the operation of the above devices with the advance of the conveyer (4 to 7).

6. A machine according to claim 5, characterized in that, downstream of the shearing station (40), it further comprises a trimming machine (41) which can shear the corners of each sheet (3) obliquely and, downstream, a gluing/turning machine(42) which can apply adhesive to the margins of the lower face of each of the sheets (3) and then turn over the margins onto the lower face of each sheet (3).

7. A machine according to claim 5, characterized in that, downstream of each of the strip applicator devices (27–30; 34), it comprises a pressing machine (31; 39).

8. A machine according to claim 5, characterized in that each cutting device (25) comprises a fixed blade (26) which is directed transversely to the advance direction of the strip (19; 36) to be cut and which is disposed above the path of the strip (19; 36), and a knife (27) which can move vertically adjacent this fixed blade (26) between a lowered position in which it extends below the strip (19; 36) to be cut and a raised position in which it extends above the edge of the fixed blade (26).

9. A machine according to claim 8, characterized in that the movable knife (27) consists of an upper edge of a movable member (27) of which the upper surface can receive the cut portion or strip (19'; 36'); this movable member (27) being associated with drive means (28–30) which can move the member against an overlying sheet (3) carried by the conveyer (4 to 7) in order to apply the cut portion or strip of strip (19'; 36') to this sheet (3).

10. A machine according to claim 9, characterized in that the drive means (28–30) are arranged so as to cause this movable member (27) to perform an upward translation movement combined with a rotation in a vertical plane, in a sense such that, when the strip portion or strip (19'; 36') is applied to a sheet (3) carried by the conveyer (4 to 7), the member (27) advances in the same direction as the conveyer (4 to 7) and substantially at the same speed.

11. A machine according to claim 9, characterized in that the upper face of the movable member (27) has a plurality of apertures communicating with a vacuum pressure source .

12. A machine according to claim 5, characterized in that each adhesive applicator device (9; 31) comprises:

a container (10) which is open at the top, contains a liquid adhesive (11), and is disposed below the conveyer (4 to 7); and a roller (12) rotatably supported between the conveyer (4 to 7) and the container (10) such that Its lower part is immersed in the adhesive (11) in the container (10), and its upper part extends adjacent the path of the sheets (3) carried by the conveyer (4 to 7).

13. A machine according to claim 12, characterized in that the roller (12) is associated with a scraper device (15) which can reduce the thickness of the adhesive (11) removed from the container (10) by the periphery of the roller (12).

14. A cover for books produced by the process according to claim 1.

15. A cover for books produced by the machine according to claim 5.

* * * * *